US006688289B2

(12) United States Patent
Rodriguez-Amaya et al.

(10) Patent No.: US 6,688,289 B2
(45) Date of Patent: Feb. 10, 2004

(54) FUEL INJECTION SYSTEM FOR INTERNAL COMBUSTION ENGINES

(75) Inventors: Nestor Rodriguez-Amaya, Stuttgart (DE); Roger Potschin, Brackenheim (DE); Juergen Gruen, Ditzingen (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 54 days.

(21) Appl. No.: 10/083,130

(22) Filed: Feb. 27, 2002

(65) Prior Publication Data

US 2002/0152992 A1 Oct. 24, 2002

(30) Foreign Application Priority Data

Feb. 28, 2001 (DE) ..... 101 09 610

(51) Int. Cl.[7] ..... F02M 41/00
(52) U.S. Cl. ..... 123/467
(58) Field of Search ..... 123/467, 446, 123/514; 239/88, 89, 90, 91, 533.2, 533.1

(56) References Cited

U.S. PATENT DOCUMENTS 5,622,152 A * 4/1997 Ishida ..... 123/446
5,671,715 A * 9/1997 Tsuzuki ..... 123/467
5,771,865 A * 6/1998 Ishida ..... 123/467
6,520,152 B1 * 2/2003 Mahr et al. ..... 12/447

FOREIGN PATENT DOCUMENTS

EP 0957261 * 11/1999

* cited by examiner

*Primary Examiner*—Mahmoud Gimie
(74) *Attorney, Agent, or Firm*—Ronald E. Greigg

(57) ABSTRACT

The fuel injection apparatus has one fuel pump for each cylinder, which has a pump piston, driven by the engine, that defines a pump work chamber, which communicates via a line with a fuel injection valve, disposed on the engine separately from the fuel pump, which valve has an injection valve member, by which at least one injection opening is controlled, and which is movable in the opening direction, counter to a closing force, by the pressure generated in the pump work chamber; a first electrically triggered control valve controls a communication of the line with a relief chamber. A second electrically triggered control valve is also disposed on the fuel injection valve and controls the pressure prevailing in a control pressure chamber of the fuel injection valve, which pressure urges the injection valve member in the closing direction.

20 Claims, 7 Drawing Sheets

FUEL INJECTION SYSTEM FOR INTERNAL COMBUSTION ENGINES

BACKGROUND OF THE INVENTION

1. Field of the Invention

The invention is directed to an improved fuel injection apparatus for internal combustion engines.

2. Description of the Prior Art

One fuel injection apparatus of the type with which this invention is concerned is known from European patent Disclosure EP 0 957 261 a1. For each cylinder of the engine, this fuel injection apparatus has one fuel pump, one fuel injection valve, and one line connecting the fuel injection valve to the fuel pump. The fuel pump has a pump piston, driven in a reciprocating motion, that defines a pump work chamber. A first electrically controlled control valve, by which a communication of the pump work chamber, and thus of the line, with a relief chamber is controlled, is disposed on the fuel pump. The fuel injection valve has an injection valve member, by which at least one injection opening is controlled and which is movable in the opening direction counter to a closing force by means of the pressure prevailing in a pressure chamber communicating with the line. A second electrically controlled control valve is provided on the fuel injection valve, by which control valve the pressure prevailing in a control pressure chamber of the fuel injection valve is controlled, by which pressure the injection valve member is urged at least indirectly in the closing direction. Both the fuel pump and the fuel injection valve have a complicated structure, because of the control valve disposed on them, and for triggering the control valves, electric lines are necessary.

SUMMARY OF THE INVENTION

The fuel injection system of the invention has the advantage over the prior art that the control valves with corresponding electric lines are disposed only on the fuel injection valve, while the fuel pump can be simple in construction, and no electric lines to it are needed.

BRIEF DESCRIPTION OF THE DRAWINGS

Several exemplary embodiments of the invention are described herein below, with reference to the drawings, in which:

FIG. 7, the fuel injection system in a fifth exemplary embodiment.

DESCRIPTION OF THE PREFERRED EMBODIMENTS

Figure 1:
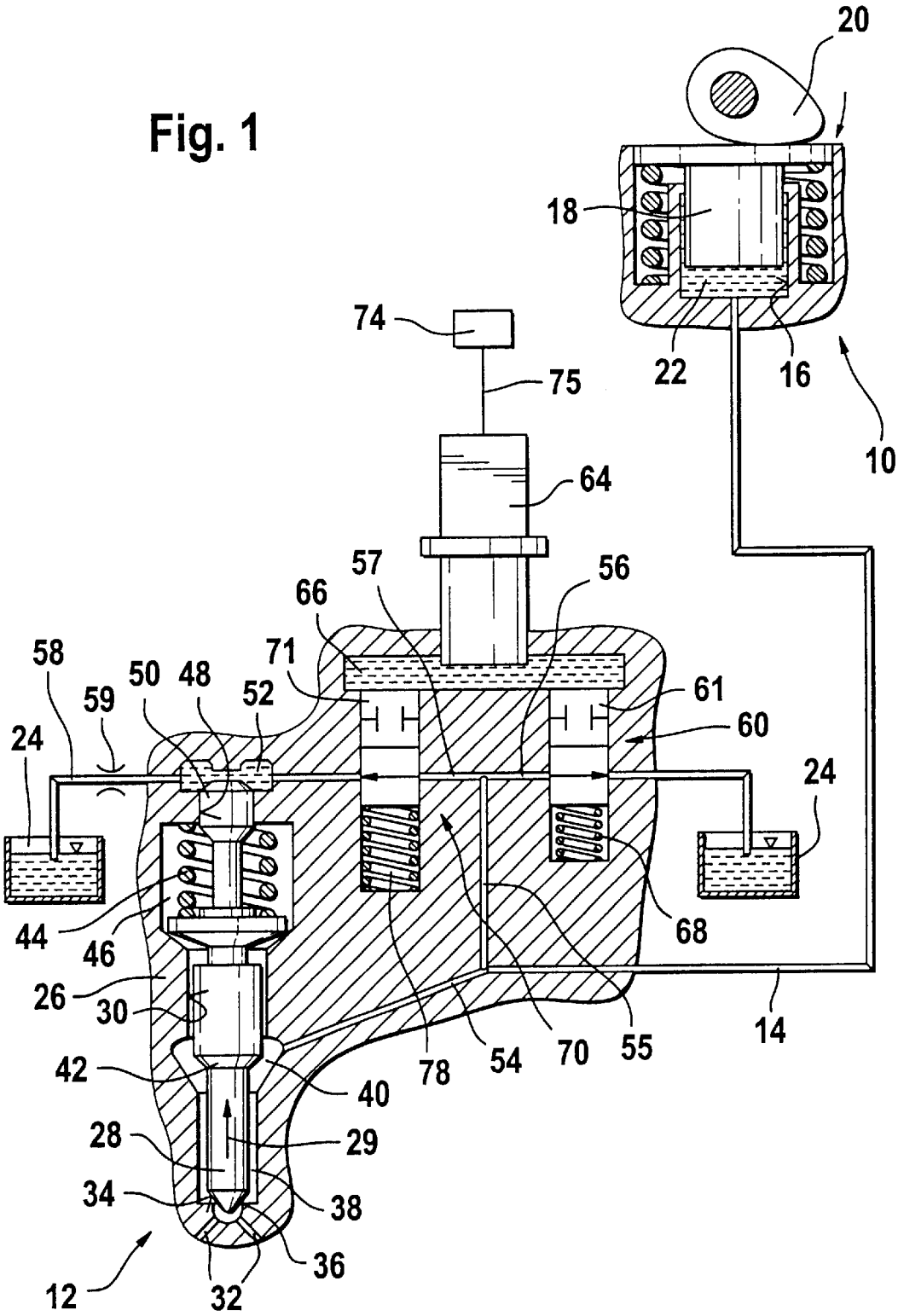
FIG. 1 shows a fuel injection apparatus for an internal combustion engine schematically in a first exemplary embodiment.

In FIGS. 1, 3, 4, 6 and 7, a fuel injection apparatus for an internal combustion engine of a motor vehicle is shown. The fuel injection apparatus is preferably embodied as a so-called pump-line-nozzle system and for each of the engine has one fuel pump 10, one fuel injection valve 12, and one line 14 connecting the fuel injection valve 12 to the fuel pump 10. The fuel pump 10 has a pump piston 18, guided tightly in a cylinder 16 and driven in a reciprocating motion by a cam 20 of a camshaft of the engine. In the cylinder 16, the pump piston 18 defines a pump work chamber 22, in which fuel is compressed at high pressure by the pump piston 18. By means of a low-pressure pump, not shown, for instance, fuel from a fuel tank 24 is delivered to the pump work chamber 22.

The fuel injection valve 12 is disposed separately from the fuel pump 10 and communicates with the pump work chamber 22 via the line 14. The fuel injection valve 12 has a valve body 26, which may be embodied in multiple parts and in which a piston-like injection valve member 28 is guided longitudinally displaceably in a bore 30. The valve body 26, in its end region oriented toward the combustion chamber of the cylinder of the engine, has at least one and preferably a plurality of injection openings 32. The injection valve member 28, in its end region toward the combustion chamber, has a sealing face 34, which for instance is approximately conical, and which cooperates with a valve seat 36, embodied in the valve body 26 in its end region toward the combustion chamber; the injection openings 32 lead away from or downstream of this valve seat. In the valve body 26, between the injection valve member 28 and the bore 30, toward the valve seat 36, there is an annular chamber 38, which as a result of a radial widening of the bore 30 changes over into a pressure chamber 40 surrounding the injection valve member 28. The injection valve member 28 has a pressure shoulder 42 In the region of the pressure chamber 40. The end remote from the combustion chamber of the injection valve member 28 is engaged by a prestressed closing spring 44, by which the injection valve member 28 is pressed toward the valve seat 36. The closing spring 44 is disposed in a spring chamber 46 of the valve body 26 that adjoins the bore 30. The spring chamber 46 is adjoined, on its end remote from the bore 30, in the valve body 26 by a further bore 48, in which a piston 50 that is joined to the injection valve member 28 is tightly guided. The piston 50, with its end face remote from the injection valve member 28, defines a control pressure chamber 52 in the valve body 26.

At the fuel injection valve 12, the line 14 branches into one line 54 leading into the pressure chamber 40 and one line 55 leading to control valves to be described in further detail below. The lines 54, 55 can be embodied as conduits in the valve body 26.

The fuel injection system has two electrically controlled control valves 60, 70, which are disposed on the fuel injection valve 12. The line 55 branches again upstream of the control valves 60, 70 into one line part 56 leading to a first control valve 60 and a second line part 57 leading to a second control valve 70.

By means of the first control valve 60, a communication of the line part 56 and thus of the lines 55 and 14 with a relief chamber is controlled; the relief chamber is for instance the fuel tank 24, or some other region where a low pressure prevails. In the first exemplary embodiment of FIG. 1, the first control valve 60 is embodied as a 2/2-way valve. The first control valve 60 has a valve member 61, which is movable between two switching positions. In a first switching position of the control valve 60, this valve opens the communication of the line part 56 with the relief chamber 24, so that in the line part 56 as well as in the line 55, the line 14 and the pressure chamber 40, high pressure cannot build up. In a second switching position, the communication of the line part 56 with the relief chamber 24 is disconnected by the control valve 60, so that in the line part 56 as well as in the line 55, the line 14 and the pressure chamber 40, high pressure can build up upon the pumping stroke of the pump piston 18.

By the second control valve 70, a communication of the line part 57 with the control pressure chamber 52 of the fuel injection valve 12 is controlled. The second control valve 70 is embodied as a 2/2-way valve and has a valve member 71, which is movable between two switching positions. In a first switching position of the control valve 70, this valve opens the communication of the control pressure chamber 52 with the line part 57 and thus with the line 55 and the line 14. In a second switching position of the control valve 70, this valve disconnects the control pressure chamber 52 from the line part 57 and thus from the line 55 and the line 14. The control pressure chamber 52 has a continuously open communication 58 with a relief chamber, as which the fuel tank 24 serves. At least one throttle restriction 59 is provided in the communication 58.

In the first exemplary embodiment, the triggering of the two control valves 60, 70 is effected via a common actuator 64, by which the pressure in an actuator pressure chamber 66 is controlled. The actuator 64 can for instance be a piezoelectric actuator, which changes its length as a function of an electrical voltage applied to it. If no voltage is applied to the actuator 64, then it has a short length, and the pressure in the actuator pressure chamber 66 is low. With increasing electrical voltage applied to the actuator 64, its length increases and the pressure in the actuator pressure chamber 66 is raised. The valve member 61 of the first control valve 60 is acted upon on one side by the pressure in the actuator pressure chamber 66 and on the other by the force of a prestressed restoring spring 68. At low pressure in the actuator pressure chamber 66, the control valve 60, because of the force of the restoring spring 68 acting on its valve member 61, is in its first switching position, in which the communication of the line part 56 with the fuel tank 24 is opened. For switching the first control valve 60 over to its second switching position, in which the line part 56 is disconnected from the fuel tank 24, such a high electrical voltage is applied to the actuator 64 that the pressure in the actuator pressure chamber 66 is high enough that the force exerted by it on the valve member 61 is greater than the force of the restoring spring 68, and the valve member 61 is moved into the second switching position. In both switching positions of the control valve 60, the valve member 61 rests on a respective stop.

The second control valve 70 likewise has a valve member 71, which is acted upon on one side by the pressure in the actuator pressure chamber 66 and on the other by the force of a prestressed restoring spring 78. At low pressure in the actuator pressure chamber 66, the control valve 70, because of the force of the restoring spring 78 acting on its valve member 71, is in its first switching position, in which the communication of the control pressure chamber 52 with the line part 57 is opened. For switching the second control valve 70 over to its second switching position, in which the control pressure chamber 52 is disconnected from the line part 57, such a high electrical voltage is applied to the actuator 64 that the pressure in the actuator pressure chamber 66 is high enough that the force exerted by it on the valve member 71 is greater than the force of the restoring spring 78, and the valve member 71 is moved into the second switching position. In both switching positions of the control valve 70, the valve member 71 rests on a respective stop.

The force exerted by the restoring spring 78 on the valve member 71 of the second control valve 70 is greater than the force exerted by the restoring spring 68 on the valve member 61 of the first control valve 60, so that for switching the second control valve 70 over to its second switching position, a higher pressure in the actuator pressure chamber 66 and thus a triggering of the actuator 64 with a higher electrical voltage is necessary, than for the switchover of the first control valve 60 to its second switching position. It is thus possible to switch the first control valve 60 over to its second switching position by increasing the pressure in the actuator pressure chamber 66, while the second control valve 70 remains in its first switching position. Upon a further pressure increase in the actuator pressure chamber 66, the second control valve 70 is switched over to its second switching position as well.

The function of the fuel injection system in the first exemplary embodiment will now be described. The control valves 60, 70 are triggered by an electric control unit 74. In the intake stroke of the pump piston 18, the first control valve 60 is in its first switching position, so that the communication of the line part 56 with the fuel tank 24 is opened, and high pressure cannot build up in the pump work chamber 22, the line 14, and the pressure chamber 40 of the fuel injection valve 12. The second control valve 70 is also in its first switching position, so that the communication of the control pressure chamber 52 with the line part 57 and thus with the line 14 and the pump work chamber 22 is open. When the injection is to begin, the actuator 64 is triggered by the control unit 74 in such a way that the pressure in the actuator pressure chamber 66 becomes so high that both control valves 60, 70 are switched over to their second switching position. The line part 56 and thus the line 14 and the pump work chamber 22 are disconnected from the fuel tank 24 by the closed first control valve 60, so that in the pressure chamber 40 of the fuel injection valve 12, high pressure builds up in accordance with the course of the profile of the cam 20. The control pressure chamber 52 is disconnected by the closed second control valve 70 from the line part 57 and thus from the line 14 and from the pump work chamber 22, so that high pressure does not prevail in the control pressure chamber 52. When the pressure prevailing in the pressure chamber 40 generates a force on the injection valve member 28 that exceeds the force of the closing spring 44, the injection valve member moves in the opening direction 29 and uncovers the injection openings 32.

Figure 2:
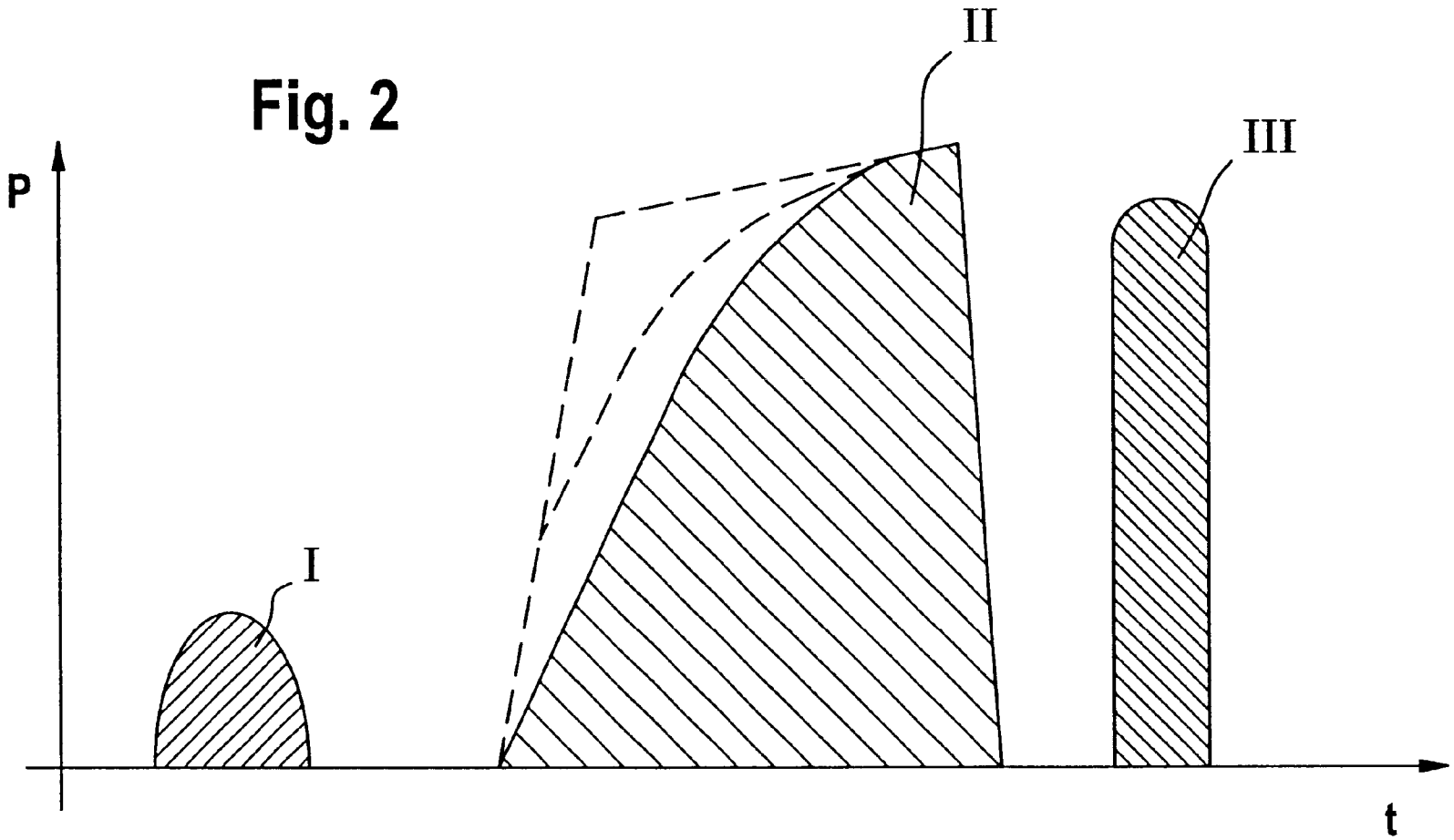
FIG. 2 shows a pressure course at injection openings of a fuel injection valve of the fuel injection apparatus in the first exemplary embodiment.

In FIG. 2, the course of the pressure at the injection openings 32 of the fuel injection valve 12 is shown over the time during one injection cycle. The fuel injection described above takes place, because of the profile of the cam 20, at relatively low pressure and with a relatively small injection quantity during a preinjection phase, marked I in FIG. 2.

To terminate the preinjection, the actuator 64 is triggered by the control unit 74 in such a way that the pressure in the actuator pressure chamber 66 drops such that the second control valve 70 moves to its first switching position, and the communication of the control pressure chamber 52 with the line part 57 and thus with the line 14 and the pump work chamber 22 is open. By means of the high pressure that then builds up in the control pressure chamber 52, a force that reinforces the closing spring 44 is generated and exerted on the injection valve member 28, so that the fuel injection valve 12 closes, and the fuel injection is interrupted. Alternatively, it can also be provided that to terminate the preinjection the actuator 64 is triggered by the control unit 74 in such a way that the pressure in the actuator pressure chamber 66 drops so severely that both control valves 60, 70 switch over to their first switching position, and by the first control valve 60 the communication of the line part 56 and thus of the line 14 and the pump work chamber 22 with the fuel tank 24 is opened, so that the pressure in the pump work chamber 22, line 14 and pressure chamber 40 is relieved to the fuel tank 24.

Next, the actuator 64 is triggered once again by the control unit 74, in such a way that the pressure in the actuator pressure chamber 66 rises so markedly that the two control valves 60, 70 are switched over to their second switching position. High pressure then builds up in the pressure chamber 40 of the fuel injection valve 12, in accordance with the profile of the cam 20, and the fuel injection valve 12 opens, since the control pressure chamber 52 is relieved. An injection of fuel then follows, in a main injection phase marked II in FIG. 2. It can be provided that the actuator 64 is triggered by the control unit 74 in such a way that initially the pressure in the actuator pressure chamber 66 rises only so markedly that only the first control valve 60 is switched over to its second switching position, while the second control valve 70 remains in its first switching position. In that case, the pressure in the pressure chamber 40 of the fuel injection valve 12 rises, but because of the high pressure prevailing in the control pressure chamber 52, the fuel injection valve 12 cannot open. Next, the actuator 64 is triggered by the control unit 74 in such a way that the pressure in the actuator pressure chamber 66 rises still more, so that the second control valve 70 is switched over into its second switching position as well, and thus high pressure no longer prevails in the control pressure chamber 25, and the fuel injection valve 12 opens. Thus with this delayed switchover of the second control valve 70, the opening pressure of the fuel injection valve 12 can be varied, and with an increasing delay, a higher opening pressure is obtained. The pressure course at the injection openings 32 in this case is represented by dashed lines in FIG. 2.

For terminating the main injection, the actuator 64 is triggered by the control unit 74 such that the pressure in the actuator pressure chamber 66 drops so sharply that the second control valve 70 switches over to its first switching position while the first control valve 60 remains in its second switching position. Thus high pressure builds up in the control pressure chamber 52, by which high pressure the fuel injection valve 12 is closed. In the pressure chamber 40, high pressure likewise prevails, because the first control valve 60 has remained in its second switching position. For a postinjection of fuel in a phase marked III in FIG. 2, the actuator 64 is triggered by the control unit 74 in such a way that the pressure in the actuator pressure chamber 66 again rises so markedly that the second control valve 70 switches over to its second switching position, so that high pressure no longer prevails in the control pressure chamber 52, and because of the high prevailing in the pressure chamber 40 the fuel injection valve 12 opens. For terminating the fuel injection, the actuator 64 is triggered by the control unit 74 in such a way that the pressure in the actuator pressure chamber 66 drops so sharply that both control valves 60, 70 switch over to their first switching position.

Because of the disposition of both control valves 60, 70 on the fuel injection valve 12, electric lines 75 to the control unit 74 are needed only for the fuel injection valve, while for the fuel pump 10, no electric lines and only the hydraulic line 14 are required. The two control valves 60, 70 are each in their first switching position when the actuator 64 is not triggered or in other words is currentless and thus when the actuator pressure chamber 66 is pressureless, so that the communication of the line part 56 with the fuel tank 24 is open, and the communication of the control pressure chamber 52 with the line part 57 is also open.

Figure 3:
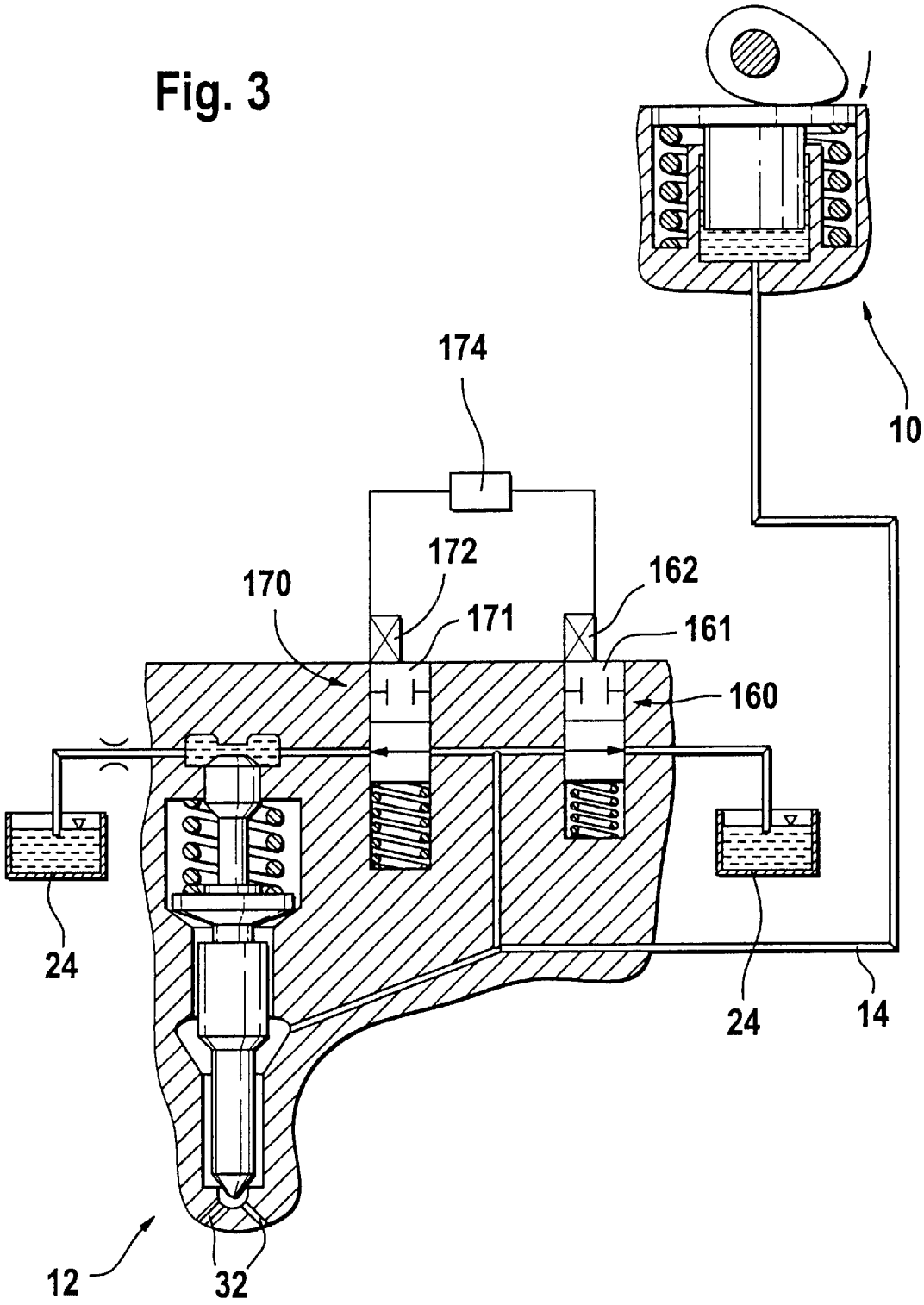
FIG. 3 shows the fuel injection apparatus in the second exemplary embodiment.

In FIG. 3, the fuel injection system in a second exemplary embodiment is shown, in which the layout is essentially the same as in the first exemplary embodiment, and the only different provided is that the two control valves 160, 170 each have their own actuator 162 and 172, respectively, for moving the respective valve member 161 and 171 counter to a respective restoring spring 168 and 178. The actuators 162, 172 can be embodied as piezoelectric actuators or as electromagnets and are triggered by the control unit 174. Once again, the two control valves 160, 170 are disposed on the fuel injection valve 12, so that no electrical lines to the fuel pump 10 are needed. The function of the fuel injection system in the second exemplary embodiment is the same as described for the first exemplary embodiment, and the pressure course shown in FIG. 2 at the injection openings 32 of the fuel injection valve 12 can be attained.

Figure 4:
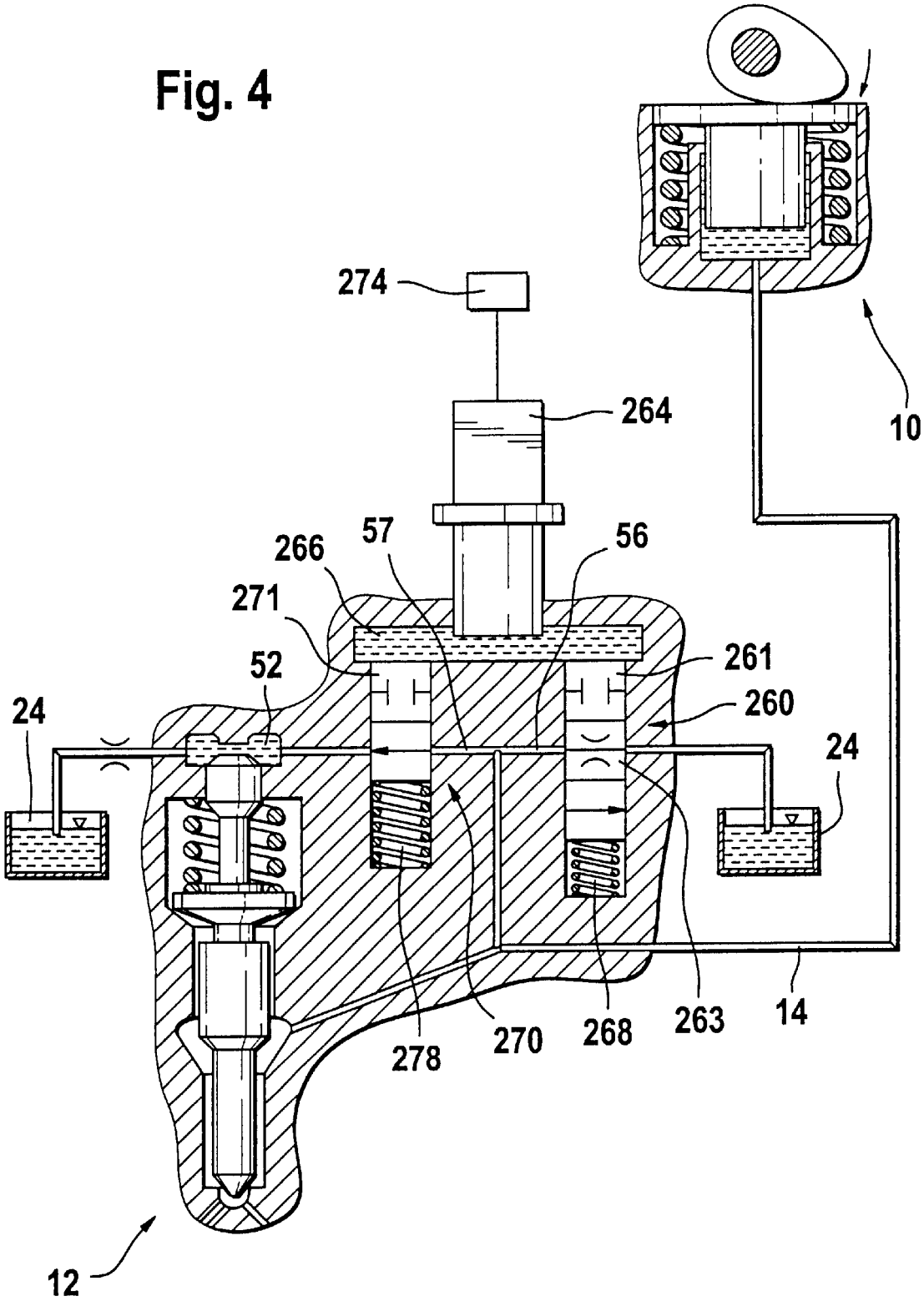
FIG. 4 shows the fuel injection apparatus in a third exemplary embodiment.

In FIG. 4, the fuel injection system is shown in a third exemplary embodiment, in which once again the basic layout is the same as in the first exemplary embodiment, but the control valves 260, 270 are modified. One common actuator 264 is provided for both control valves 260, 270; it is triggered by the control unit 274 and by it the pressure in the actuator pressure chamber 266 can be controlled. The first control valve 260 is embodied as a 2/3-way valve, which has a valve member 261 that is acted upon on one side by the pressure in the actuator pressure chamber 266 and on the other by the force of a restoring spring 268. The first control valve 260 is switchable among three switching positions. In a first switching position of the control valve 260, the communication of the line part 56, and thus of the line 14 and the pump work chamber 22, with the fuel tank 24 is fully open. In a second switching position of the control valve 260, the communication of the line part 56, and thus of the line 14 and the pump work chamber 22, with the fuel tank 24 is open via a throttle restriction 263, with a smaller cross section than in the first switching position. In a third switching position of the control valve 260, the line part 56, and thus the line 14 and the pump work chamber 22, are disconnected from the fuel tank 24. When the actuator 264 is not triggered and the pressure in the actuator pressure chamber 266 is accordingly low, the first control valve 260 is in its first switching position, in which the communication of the line part 56 with the fuel tank 24 is fully open. With the actuator 264 triggered in such a way that the pressure in the actuator pressure chamber 266 is somewhat elevated, the first control valve 260 is in its second switching position, in which the communication of the line part 56 with the fuel tank 24 is open via the throttle restriction 263. With the actuator 264 triggered in such a way that a high pressure prevails in the actuator pressure chamber 266, the control valve 260 is in its third switching position, in which the line part 56 is disconnected from the fuel tank 24.

The second control valve 270 is, as in the first exemplary embodiment, embodied as a 2/2-way valve and has a valve member 271 that is displaceable counter to the force of a restoring spring 278. When the actuator 264 is not triggered and the pressure in the actuator pressure chamber 266 is accordingly low, the second control valve 270 is in a first switching position, in which the control pressure chamber 52 is disconnected from the line part 57. When the actuator 264 is triggered in such a way that a high pressure prevails in the actuator pressure chamber 266, the control valve 270 is in a second switching position, in which the communication of the control pressure chamber 52 with the line part 57 is open. For the switchover of the second control valve 270 into its second switching position, a higher pressure in the actuator pressure chamber 266 is needed than for the switchover of the first control valve 260 into its third switching position. The prestressing of the restoring spring 278 of the second control valve 270 can be greater here than the prestressing of the restoring spring 268 of the first control valve 260.

Figure 5:
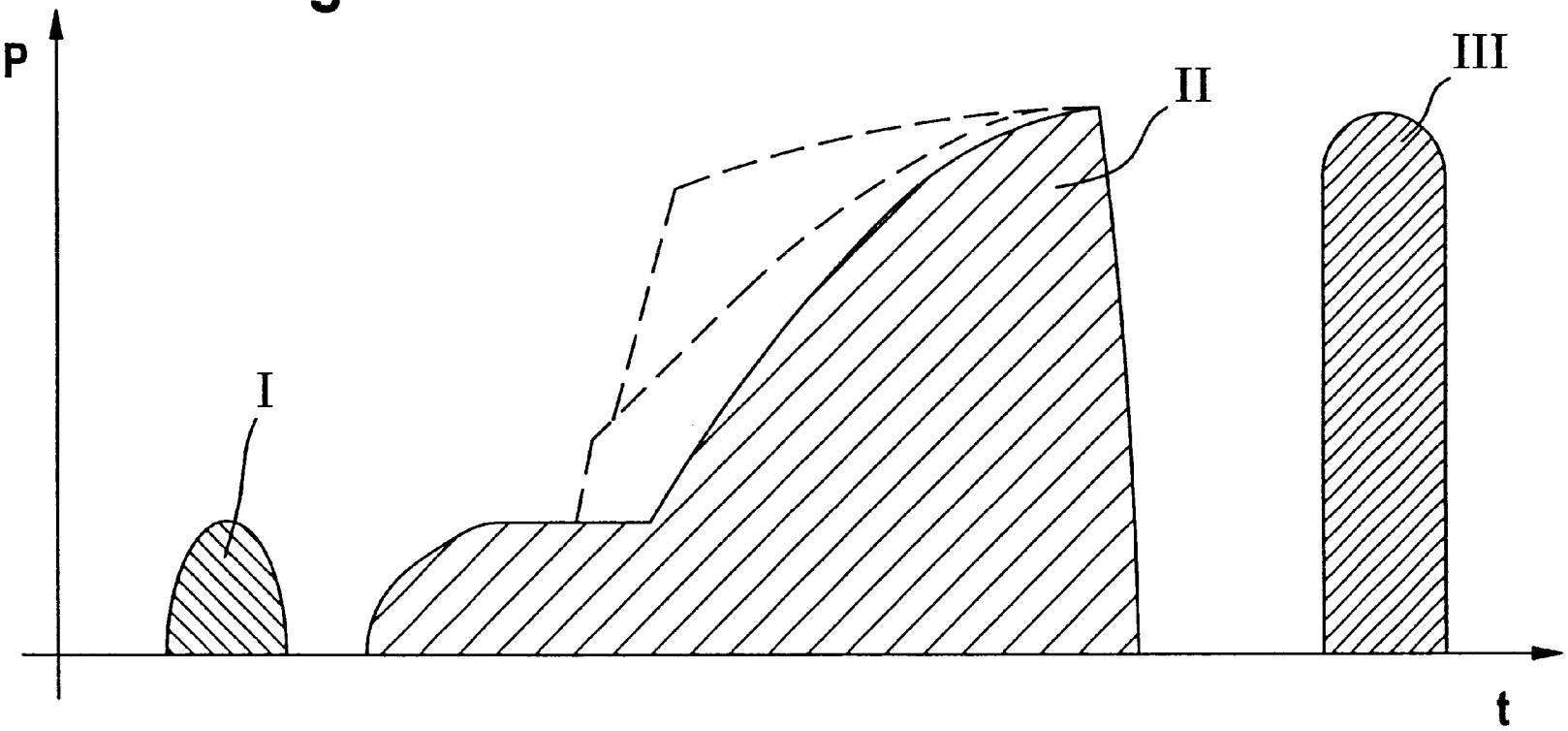
FIG. 5, a pressure course at injection openings of the fuel injection valve of the fuel injection system in the third exemplary embodiment.

The function of the fuel injection system in the third exemplary embodiment will now be described, to the extent that it deviates from that of the first exemplary embodiment. In FIG. 5, the course over time of the pressure at the injection openings 32 of the fuel injection valve 12 during one injection cycle is shown for the fuel injection system of the third exemplary embodiment. For the preinjection in phase I, the first control valve 260 is put into its third switching position by suitable triggering of the actuator 264, while the second control valve 270 remains in its first switching position. For terminating the preinjection, the actuator 264 is no longer triggered, so that the first control valve 260 switches over to its first switching position.

For the main injection in phase II, the first control valve 260 is put in its second switching position by suitable triggering of the actuator 264, so that the line part 56, and thus the line 54 and the pump work chamber 22, communicate with the fuel tank 24 via the throttle restriction 263. Via the throttle restriction 263, fuel can flow out into the fuel tank 24, so that in the pump work chamber 22, line 14 and pressure chamber 40, instead of the full pressure corresponding to the profile of the cam 20, only a lesser pressure can build up, by which pressure the fuel injection valve 12 is opened and the fuel injection is effected. The main injection therefore begins at a relatively low pressure, as is shown in FIG. 5. With a delay after the onset of the main injection, the first control valve 260 is switched over to its third switching position by suitable triggering of the actuator 264, so that the line part 56 and the line 14, as well as the pump work chamber 22, are disconnected from the fuel tank 24, and in the pressure chamber, the full pressure corresponding to the profile of the cam 20 builds up, and the fuel injection takes place at high pressure.

To terminate the main injection, the second control valve 270 is put in its second switching position by suitable triggering of the actuator 264 and establishment of a high pressure in the actuator pressure chamber 266, so that the control pressure chamber 52 communicates with the line part 57, and thus with the line 14 and the pump work chamber 22, and accordingly high pressure prevails in the control pressure chamber 52, and the fuel injection valve 12 closes. For a postinjection in phase III, the actuator 264 is triggered again in such a way that the pressure in the actuator pressure chamber 266 drops, so that the second control valve 270 returns to its first switching position, and the control pressure chamber 52 is disconnected from the line part 57, so that because of the pressure prevailing in the pressure chamber 40, the fuel injection valve 12 opens again. For terminating the postinjection, the actuator 264 is triggered such that the pressure in the actuator pressure chamber 266 drops so sharply that the control valves 260, 270 switch back over to their first switching positions.

Figure 6:
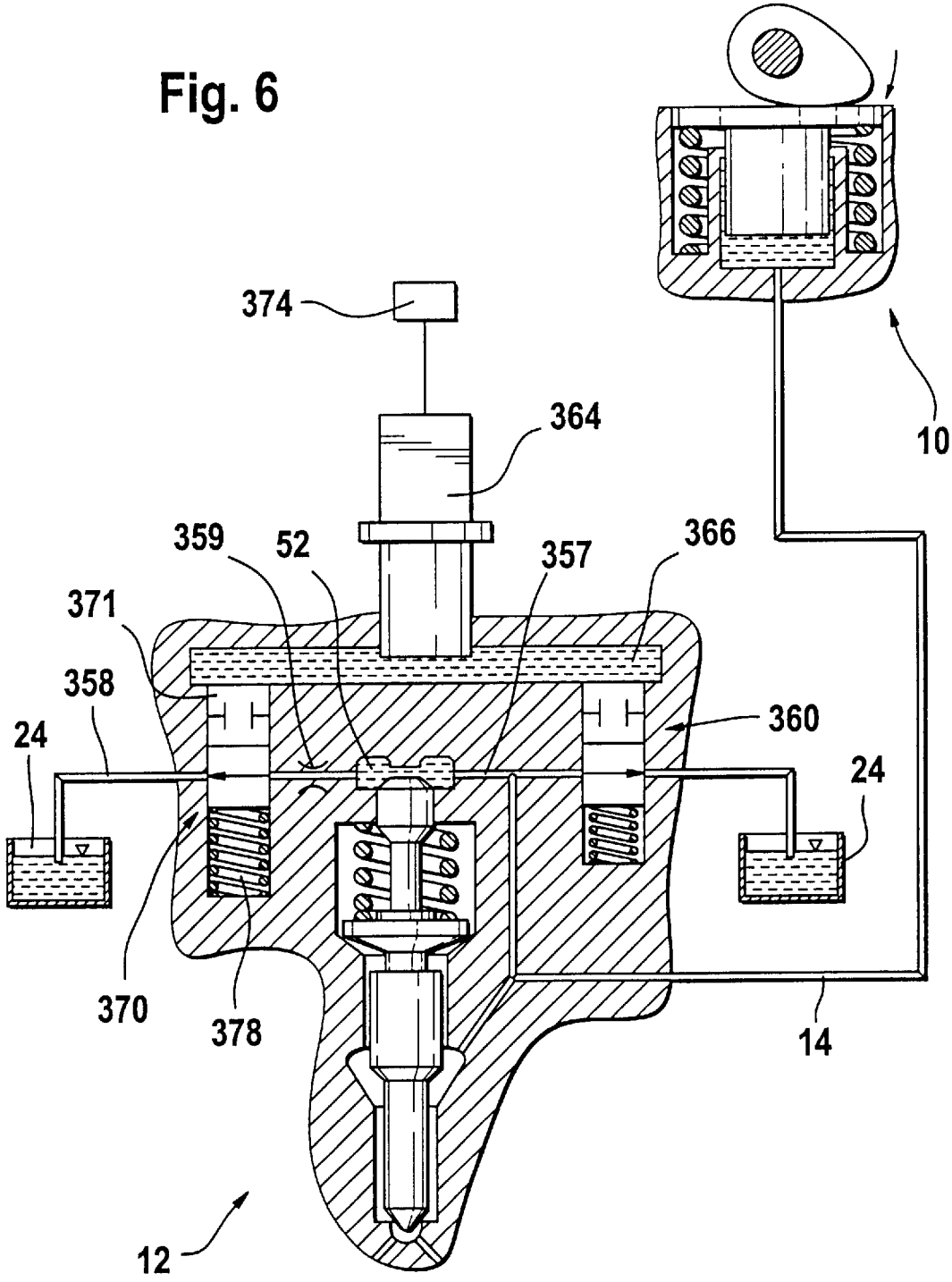
FIGS. 6 and 7, FIG. 6, the fuel injection system in a fourth exemplary embodiment.

In FIG. 6, the fuel injection system is shown in a fourth exemplary embodiment, in which the basic layout is the same as in the first exemplary embodiment, and only the disposition of the second control valve 370 is changed. Accordingly, only the disposition and embodiment of the second control valve 370 will be described in detail below. The line part 357 discharges into the control pressure chamber 52 and is continuously open, and a throttle restriction may be provided in it. From the control pressure chamber 52, a communication 358 leads to a relief chamber, as which the fuel tank 24 for instance serves. By the second control valve 370, the communication 358 of the control pressure chamber 52 with the fuel tank 24 is controlled. At least one throttle restriction 359 is provided in the communication 358. The second control valve 370 is embodied as a 2/2-way valve and has a valve member 371, which is movable between two switching positions counter to the force of a restoring spring 378. In a first switching position of the control valve 370, this valve opens the communication 358 of the control pressure chamber 52 with the fuel tank 24. In a second switching position of the control valve 370, this valve disconnects the control pressure chamber 52 from the fuel tank 24. The two control valves 360, 370 are triggered by a common actuator 364, by which the pressure in an actuator pressure chamber 366 is determined. The mode of operation of the fuel injection system in the fourth exemplary embodiment is the same as in the first exemplary embodiment, but during the injection the second control valve 370 is in its first switching position, in which the communication 358 of the control pressure chamber 52 with the fuel tank 24 is open, so that high pressure cannot build up in the control pressure chamber 52. During the injection, the first control valve 360 is in its second switching position, in which the line part 356 is disconnected from the fuel tank 24. The actuator 364 is triggered by the control unit 374 during the injection in such a way that a sufficiently high pressure prevails in the actuator pressure chamber 366 to switch the first control valve 360 to its second switching position, while the second control valve 370 remains in its first switching position. For terminating the injection, the second control valve 370 is switched over to its second switching position by an elevation of the pressure in the actuator pressure chamber 366, so that the control pressure chamber 52 is disconnected from the fuel tank 24 and a high pressure builds up in it, by which the fuel injection valve 12 is closed. With the fuel injection system in the fourth exemplary embodiment, a pressure course at the injection openings 32 of the fuel injection valve 12 in accordance with FIG. 2 can be achieved. When the actuator 364 is not triggered or in other words is currentless, the second control valve 370 is in its first switching position, in which the communication 358 of the control pressure chamber 52 with the fuel tank 24 is open.

Instead of the first control valve 360 embodied as a 2/2-way valve, in the fuel injection system of the fourth exemplary embodiment a first control valve embodied as a 2/3-way valve can also be provided, as in the third exemplary embodiment of FIG. 4. Thus a pressure course at the injection openings 32 of the fuel injection valve 12 in accordance with FIG. 5 can be achieved.

In the fuel injection system of the fourth exemplary embodiment, it can moreover be provided that as in the second exemplary embodiment of FIG. 2, separate actuators for the control valves 360, 370 are provided.

Figure 7:
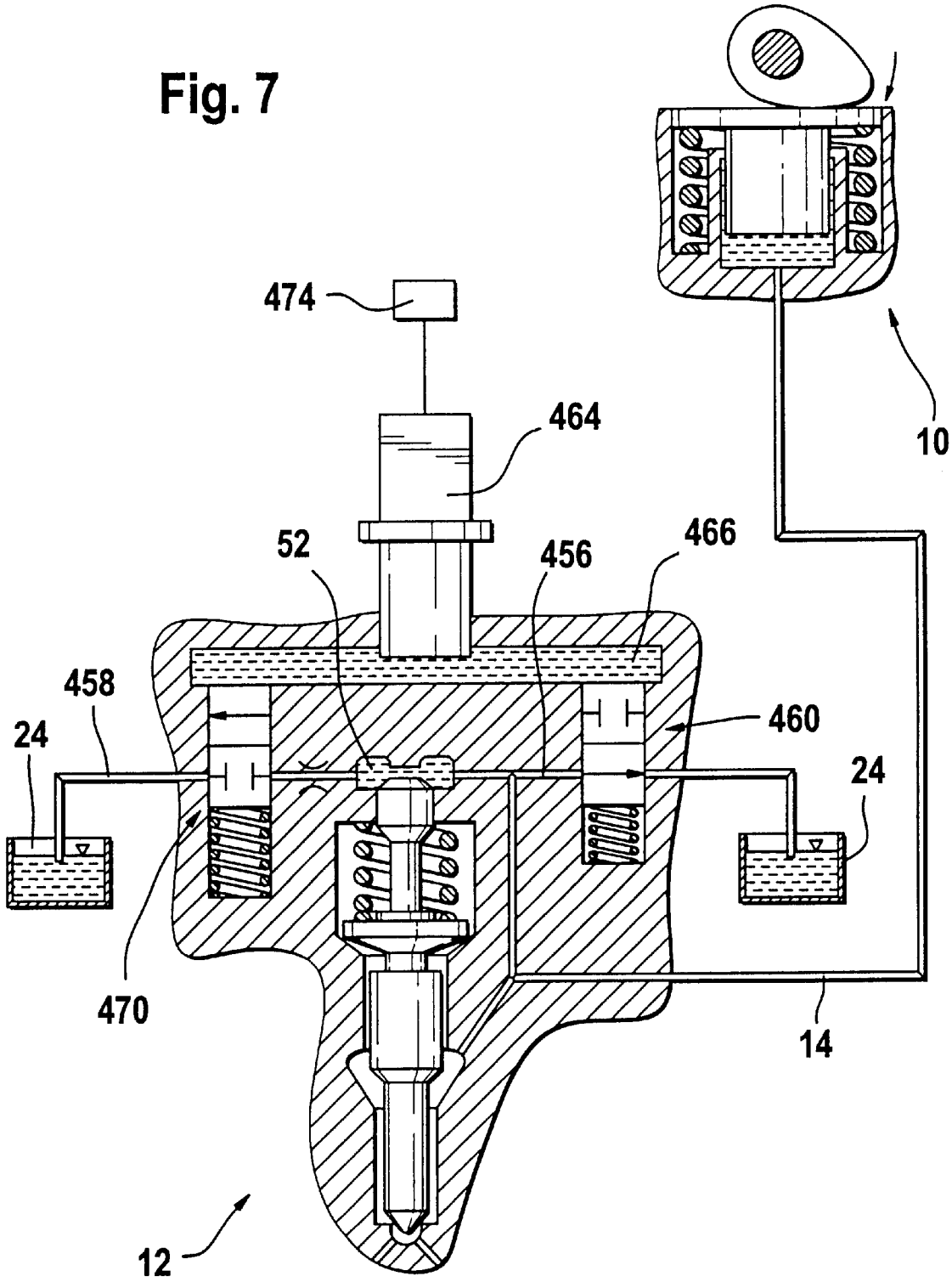

In FIG. 7, the fuel injection system is shown in a fifth exemplary embodiment, in which compared to the fourth exemplary embodiment only the switching positions of the second control valve 470 are transposed. In its first switching position, the second control valve 470 disconnects the control pressure chamber 52 from the fuel tank 24, and in its second switching position, the second control valve 470 opens the communication 458 of the control pressure chamber 52 with the fuel tank 24. When the actuator 464 is not triggered or in other words is currentless, the second control valve 470 is in its first switching position, in which the control pressure chamber 52 is disconnected from the fuel tank 24. During the injection, the actuator 464 is triggered by the control unit 474 in such a way that an adequately high pressure prevails in the actuator pressure chamber 466 to switch both the first control valve 460 and the second control valve 470 to their second switching positions. For terminating the injection, the pressure in the actuator pressure chamber 466 is reduced by suitable triggering of the actuator 464 such that the second control valve 470 switches over to its first switching position, so that the control pressure chamber 52 is disconnected from the fuel tank 24, but the first control valve 460 remains in its second switching position, so that the line 456 is disconnected from the fuel tank 24.

The foregoing relates to preferred exemplary embodiments of the invention, it being understood that other variants and embodiments thereof are possible within the spirit and scope of the invention, the latter being defined by the appended claims.

We claim:

1. In a fuel injection system for internal combustion engines, having one fuel pump (10) for each cylinder of the engine, which pump has a pump piston (18), driven by the engine in a reciprocating motion, that defines a pump work chamber (22), which communicates via a line (14) with a fuel injection valve (12), disposed on the engine separately from the fuel pump (10), which valve has an injection valve member (28), by which at least one injection opening (32) is controlled, and which is movable in the opening direction (29), counter to a closing force, by the pressure generated in the pump work chamber (22), wherein at least one first electrically controlled control valve (60; 160; 260; 360; 460) is provided, by which at least indirectly a communication of the pump work chamber (22) with a relief chamber (24) is controlled, and wherein a second electrically triggered control valve (70; 170; 270; 370; 470) is provided, by which the pressure prevailing in a control pressure chamber (52) of the fuel injection valve (12) is controlled, by which pressure the injection valve member (28) is urged at least indirectly in the closing direction, the improvement wherein both control valves (60; 160; 260; 360; 460 and 70; 170; 270; 370; 470) are disposed on the fuel injection valve (12).

2. The fuel injection system of claim 1, wherein the line (14) discharges into a valve body (26) of the fuel injection valve (12) and, in it, branches into one line (54) discharging into a pressure chamber (40) surrounding the injection valve member (28) and another line (55) leading to the control valves (60; 160; 260; 360; 460 and 70; 170; 270; 370; 470).

3. The fuel injection system of claim 1, wherein by the second control valve (70; 170; 270), a communication of the control pressure chamber (52) at least indirectly with the line (14) is controlled.

4. The fuel injection system of claim 2, wherein by the second control valve (70; 170; 270), a communication of the control pressure chamber (52) at least indirectly with the line (14) is controlled.

5. The fuel injection system of claim 3, wherein the control pressure chamber (52) has a continuously open communication (58) with a relief chamber (24), in which at least one throttle restriction (59) is provided.

6. The fuel injection system of claim 4, wherein the control pressure chamber (52) has a continuously open communication (58) with a relief chamber (24), in which at least one throttle restriction (59) is provided.

7. The fuel injection system of claim 3, wherein the second control valve (70; 170; 270) is a 2/2-way valve, by which in a first switching position the control pressure chamber (52) communicates at least indirectly with the line (14), and by which in a second switching position the control pressure chamber (52) is disconnected from the line (14).

8. The fuel injection system of claim 4, wherein the second control valve (70; 170; 270) is a 2/2-way valve, by which in a first switching position the control pressure chamber (52) communicates at least indirectly with the line (14), and by which in a second switching position the control pressure chamber (52) is disconnected from the line (14).

9. The fuel injection system of claim 5, wherein the second control valve (70; 170; 270) is a 2/2-way valve, by which in a first switching position the control pressure chamber (52) communicates at least indirectly with the line (14), and by which in a second switching position the control pressure chamber (52) is disconnected from the line (14).

10. The fuel injection system of claim 6, wherein the second control valve (70; 170; 270) is a 2/2-way valve, by which in a first switching position the control pressure chamber (52) communicates at least indirectly with the line (14), and by which in a second switching position the control pressure chamber (52) is disconnected from the line (14).

11. The fuel injection system of claim 1, wherein the control pressure chamber (52) has a continuously open communication (358; 458) at least indirectly with the line (14), and that by the second control valve (370; 470), a communication (358; 458) of the control pressure chamber (52) with the relief chamber (24) is controlled.

12. The fuel injection system of claim 2, wherein the control pressure chamber (52) has a continuously open communication (358; 458) at least indirectly with the line (14), and that by the second control valve (370; 470), a communication (358; 458) of the control pressure chamber (52) with the relief chamber (24) is controlled.

13. The fuel injection system of claim 11, wherein in the communication (358; 458) of the control pressure chamber (52) with the relief chamber (24), at least one throttle restriction (359; 459) is provided.

14. The fuel injection system of claim 12, wherein the control pressure chamber (52) has a continuously open communication (358; 458) at least indirectly with the line (14), and that by the second control valve (370; 470), a communication (358; 458) of the control pressure chamber (52) with the relief chamber (24) is controlled.

15. The fuel injection system according to claim 11, wherein the second control valve (370; 470) is a 2/2-way valve, by which in a first switching position the control pressure chamber (52) communicates with the relief chamber (24) and by which in a second switching position the control pressure chamber (52) is disconnected from the relief chamber (24).

16. The fuel injection system according to claim 13, wherein the second control valve (370; 470) is a 2/2-way valve, by which in a first switching position the control pressure chamber (52) communicates with the relief chamber (24) and by which in a second switching position the control pressure chamber (52) is disconnected from the relief chamber (24).

17. The fuel injection system according to claim 1, wherein the first control valve (60; 160; 360; 460) is a 2/2-way valve, by which in a first switching position the line (14) communicates at least indirectly with the relief chamber (24) and by which in a second switching position the line (14) is disconnected from the relief chamber (24).

18. The fuel injection system according to claim 1, wherein the first control valve (260; 360) is 2/3-way valve, by which in a first switching position the line (14) communicates unthrottled at least indirectly with the relief chamber (24), by which in a second switching position the line (14) communicates at least indirectly with the relief chamber (24) via a throttle restriction (263), and by which in a third switching position the line (14) is disconnected from the relief chamber (24).

19. The fuel injection system according to claim 1, wherein both control valves (60; 260; 360; 460; 70; 270; 370; 470) are controlled by a common actuator (64; 264; 364; 464).

20. In a fuel injection system for internal combustion engines, having one fuel pump (10) for each cylinder of the engine, which pump has a pump piston (18), driven by the engine in a reciprocating motion, that defines a pump work chamber (22), which communicates via a line (14) with a fuel injection valve (12), disposed on the engine separately from the fuel pump (10), which valve has an injection valve member (28), by which at least one injection opening (32) is controlled, and which is movable in the opening direction (29), counter to a closing force, by the pressure generated in the pump work chamber (22), wherein at least one first electrically controlled control valve (60; 160; 260; 360; 460) is provided, by which at least indirectly a communication of the pump work chamber (22) with a relief chamber (24) is controlled, and wherein a second electrically triggered control valve (70; 170; 270; 370; 470) is provided, by which the pressure prevailing in a control pressure chamber (52) of the fuel injection valve (12) is controlled, by which pressure the injection valve member (28) is urged at least indirectly in the closing direction, the improvement wherein both control valves (60; 160; 260; 360; 460 and 70; 170; 270; 370; 470) are disposed on the fuel injection valve (12), and wherein the line (14) discharges into a valve body (26) of the fuel injection valve (12) and, in it, branches into one line (54) discharging into a pressure chamber (40) surrounding the injection valve member (28) and another line (55) leading to the control valves (60; 160; 260; 360; 460 and 70; 170; 270; 370; 470), and further wherein the connection (14, 55, 56), controlled by the first valve (60; 160; 260; 360; 460), of the pump work chamber (22) and the relief chamber (24) leads away upstream of the orifice of the line (57) leading into the control pressure chamber (52).

* * * * *